United States Patent [19]

Kinosz et al.

[11] 4,121,983

[45] Oct. 24, 1978

[54] METAL PRODUCTION

[75] Inventors: Donald L. Kinosz, Arnold; Subodh K. Das, Apollo; Robert L. Coffman, Lower Burrell, all of Pa.

[73] Assignee: Aluminum Company of America, Pittsburgh, Pa.

[21] Appl. No.: 862,829

[22] Filed: Dec. 21, 1977

[51] Int. Cl.[2] ..... C25C 3/06; C25C 3/04; C25B 11/12

[52] U.S. Cl. ..... 204/67; 204/70; 204/294

[58] Field of Search ..... 204/67–70, 204/64 R, 294, 64–66

[56] References Cited

U.S. PATENT DOCUMENTS

| | | | |
|---|---|---|---|
| 1,569,606 | 1/1926 | Ashcroft | 204/70 |
| 3,822,195 | 7/1974 | Dell et al. | 204/70 X |
| 3,960,696 | 6/1976 | Wittner | 204/67 X |
| 4,046,650 | 9/1977 | Hirasawa et al. | 204/294 X |

*Primary Examiner*—John H. Mack
*Assistant Examiner*—D. R. Valentine
*Attorney, Agent, or Firm*—Andrew Alexander

[57] ABSTRACT

A process is provided for producing aluminum in an electrolytic cell containing aluminum chloride dissolved in a molten solvent of higher decomposition potential. The cell has a terminal anode, a terminal cathode and a bipolar electrode arranged to operate with the anode and the cathode, providing interelectrode spaces therebetween. On electrolyzing the cell chlorine is produced on each anode surface thereof and aluminum on each cathode surface, the aluminum being swept from the cathode surface by bath material. In the process, carbonaceous material is provided for use as the electrode. The direction of grain flow constituting the carbonaceous material is determined and the electrode is arranged in the cell such that the direction of electrolysis current flow through the cell is in a direction substantially perpendicular to the direction of grain flow in the electrode.

11 Claims, 2 Drawing Figures

METAL PRODUCTION

INTRODUCTION

This invention relates to the production of light metals, for example aluminum or magnesium, in an electrolytic cell. More particularly, the invention relates to carbon electrodes for electrolytic cells used in the production of metal from its metal chloride.

One type of cell used for the production of light metal from its metal chloride includes an anode, at least one intermediate bipolar electrode and a cathode in superimposed spaced relationship defining interelectrode spaces. The spaces provide for selectively directed bath flow therethrough. Such cell structure is disclosed in U.S. Pat. No. 822,195, incorporated herein by reference. However, one of the problems attendant operating such a cell is maintaining a relatively fixed anode-cathode spacing during operation of the cell. The fixed spacing ensures that high current efficiency and power consumption do not change with operation of the cell. The spacing referred to is on the order of less than ¾ inch and is disclosed in U.S. Pat. No. 3,755,099, incorporated herein by reference. It should be understood that it is exceptionally difficult to maintain a set spacing with continued use of the cell. For example, as indicated in U.S. Pat. No. 3,725,222, incorporated herein by reference, when the bath contains alkali metal halide or alkaline earth metal halides as the solvent for aluminum chloride, carbonaceous cathodes of the cell are attacked by alkali metal or alkaline earth metal produced by electrolysis of such salts, causing spalling and shrinkage of the cathodes, with attendant change in the anode-cathode distance and increase in maintenance expenses. In addition, particles of carbon end up in the electrolyte and contribute to formation of sludge at the cathode. Also, it is noted that oxygen reacts with the carbon to form gaseous oxides resulting in consumption of anode carbon which affects the operating characteristics of the cell by deleteriously changing the anode-cathode distance, as well as adding to anode expense. Because of the severity of this problem, extensive research has been conducted to discover means which would further aid in maintaining a desired anode-cathode distance, obviating problems which arise with changes in the anode-cathode distance.

Thus, the present invention provides a method which greatly minimizes changes in anode-cathode distance in a bipolar cell and the problems attendant such changes.

SUMMARY

An object of the present invention is to provide an electrode for use in a cell for producing metal from its metal halide.

Another object of the present invention is to provide a method for production of a light metal from its metal chloride by electrolysis wherein changes in the anode-cathode distance are minimized.

Yet another object of the present invention is to provide a carbonaceous electrode for use in an electrolytic cell for the production of a light metal, the electrode arranged so as to minimize changes in the anode-cathode distance upon operation of the cell.

These and other objects will be apparent from the drawing, specification and claims appended hereto.

In accordance with these objects there is provided a process for producing metal in an electrolytic cell containing metal halide dissolved in a molten solvent of higher decomposition potential. The cell has a terminal anode, a terminal cathode and at least one bipolar electrode arranged to operate with the anode and the cathode, providing interelectrode spaces therebetween. The halogen gas is produced on each anode surface thereof and metal on each cathode surface by electrolyzing the cell. In the process, carbonaceous material is provided for use as the electrode. The direction of grain flow, i.e. grain orientation, constituting the carbonaceous material is determined and the electrode is arranged in the cell such that the current flow through the cell is in a direction substantially perpendicular to the direction of grain flow in the electrode.

DETAILED DESCRIPTION OF THE PREFERRED EMBODIMENTS

Figure 1:
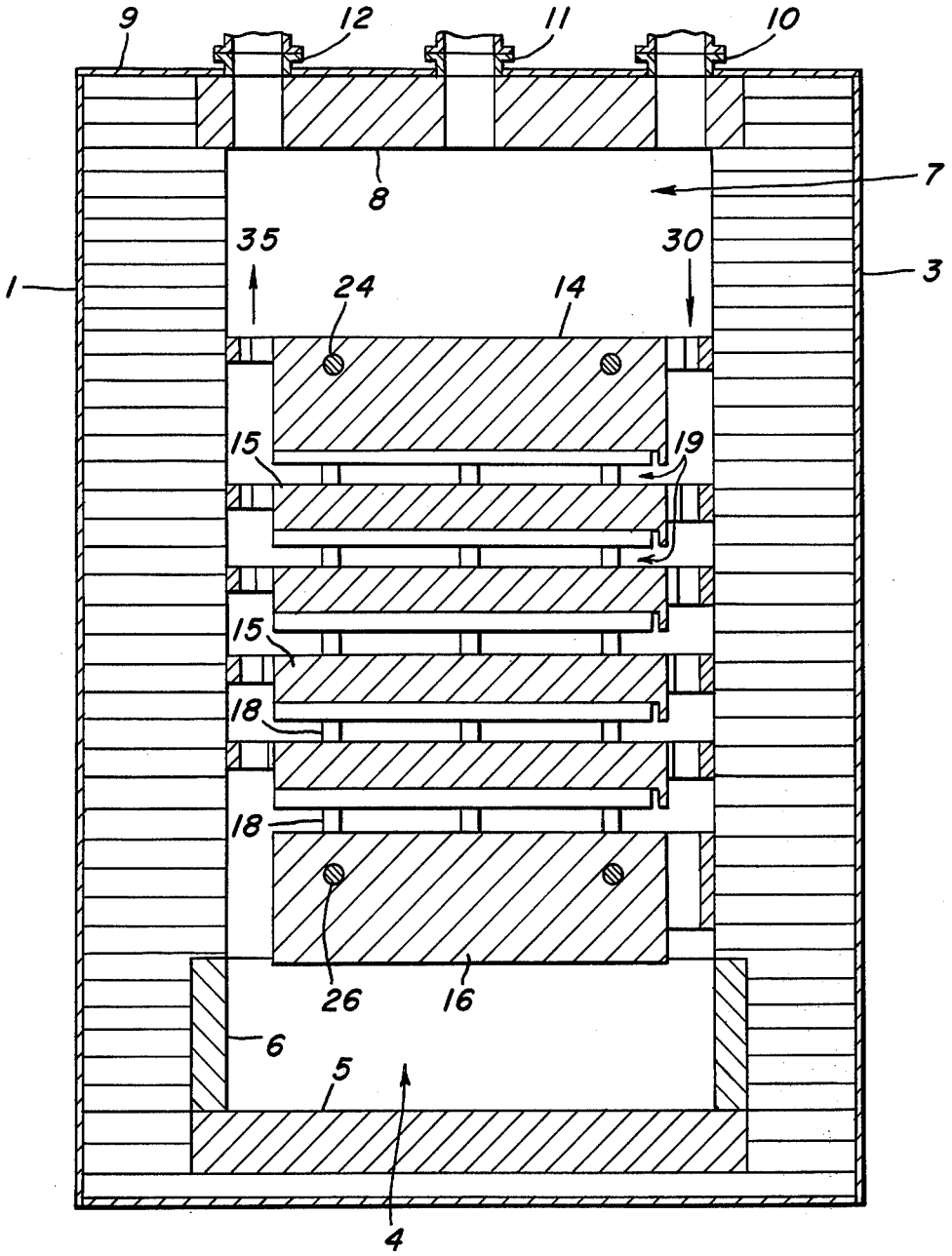
FIG. 1 is a sectional elevation illustrative of a cell for producing light metal in accordance with the invention.

Referring particularly to FIG. 1, the cell illustrated includes an outer steel shell 1, which is lined with refractory sidewall and end wall brick 3 made of thermally insulating, electrically nonconductive material which is resistant to molten aluminum chloride-containing halide bath and the decomposition products thereof. The cell cavity accommodates a sump 4 in the lower portion for collecting the aluminum metal produced. The sump bottom 5 and walls 6 are preferably made of graphite. The cell cavity also accommodates a bath reservoir 7 in its upper zone. The cell is enclosed by a refractory roof 8 and a lid 9. A first port 10, extending through the lid 9 and roof 8, provides for insertion of a tapping tube down into sump 4, through an internal passage to be described later, for removing molten aluminum. A second port 11 provides inlet means for feeding aluminum chloride into the bath. A third port 12 provides outlet means for venting chloride.

The cell cavity contains a plurality of plate-like electrodes which include an upper terminal anode 14, desirably an appreciable number of bipolar electrodes 15 (four being shown) and a lower terminal cathode 16. These electrodes are arranged in superimposed relation with each electrode preferably being horizontally disposed within a vertical stack. The cathode 16 is supported at each end on sump walls 6. The remaining electrodes are stacked one above the other in a spaced relationship established by interposed refractory pillars 18. Such pillars 18 are sized to closely space the electrodes, as for example to space them with their opposed surfaces separated by less than ¾ inch. In the illustrated embodiment, five interelectrode spaces 19 are formed between opposed electrodes, one between cathode 16 and the lowest of the bipolar electrodes 15, three between successive pairs of intermediate bipolar electrodes 15 and one between the highest of the bipolar electrodes 15 and anode 14. Each interelectrode space is bounded by an upper surface of one electrode (which functions as an anode surface) opposite a lower surface of another electrode (which functions as a cathode surface), and the spacing therebetween, e.g. about ½ inch, is referred to herein as the anode-cathode distance (the electrode to electrode distance being the effective anode-cathode distance in the absence of a metal layer of substantial thickness). The bath level in the cell will vary in operation but normally will lie well above the anode 14, thus filling all otherwise unoccupied space therebelow within the cell.

Anode 14 has a plurality of electrode bars 24 inserted therein which serve as positive current leads, and cathode 16 has a plurality of collector bars 26 inserted therein which serve as negative current leads. The bars 24 and 26 extend through the cell wall and are suitably insulated from the steel shell 1.

As noted earlier, the sump 4 is adapted to contain bath and molten aluminum, and the latter may accumulate beneath the bath in the sump during operation. Should it be desired to separately heat the bath and any metal in sump 4, an auxiliary heating circuit may be established therein.

Figure 2:
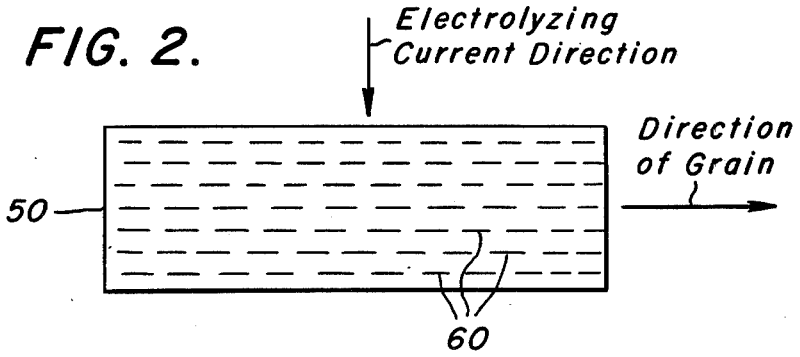
FIG. 2 is a schematic representation illustrating orientation of grains with respect to electrolyzing current flow in accordance with the principles of the subject invention.

In accordance with the principles of the present invention, bipolar electrodes 15 are comprised of a carbonaceous material and are arranged so that electrolytic current flow through the cell from the anode to the cathode is substantially perpendicular to the direction of grain flow. That is, during formulation of the electrode typically by extrusion from a carbonaceous mix, grains in the carbonaceous material are oriented in a certain fashion. A schematic representation merely for purposes of illustrating the orientation of the grains resulting from extruding, for example, carbonaceous material, is shown in FIG. 2. That is, FIG. 2 is provided for illustrating one embodiment of the invention. In FIG. 2, it will be seen that grains substantially needle shaped and referred to as acicular and referred to as 60, in carbonaceous block 50 are arranged such that the long axis of the grains 60 are aligned in a substantially parallel manner. It is the determining of the alignment or orientation of the long axis which is so important in the process of the present invention since this orientation contributes greatly to minimizing changes in anode-cathode distance. For purposes of the present invention, grain direction is referred to as a direction substantially parallel to the long axis of the grains substantially as illustrated in FIG. 2. In addition, by electrolyzing so as to have a current flow substantially perpendicular to the grain direction is meant a direction substantially parallel to the short axis of the grains similar to that depicted in FIG. 2.

The flow direction of the grains may be determined by measuring the electrical resistivity. When electrical resistivity is used, the electrode should be arranged in the cell so that the cell electrolyzing current flows substantially perpendicular to the direction of the electrodes lowest electrical resistivity. For example, if in an electrode of carbonaceous material the electrical resistivities were 5.1, 6.4 and 7.9 $\mu\Omega$m in the respective directions, then the electrode should be arranged so that the cell electrolyzing current flows substantially perpendicular to the direction providing the 5.1 $\mu\Omega$m reading. It is believed that the direction of lowest electrical resistivity is in the direction of grain flow. It will be understood that if a combination of cokes comprising acicular (needle shaped grains) and isotropic cokes are used for the carbonaceous material in the electrode, the cell electrolyzing current should be passed as described earlier. That is, the electrolyzing current should be passed substantially perpendicular to the direction of grain flow of the acicular coke component.

While the inventors do not necessarily wish to be bound by any theory of invention, it is believed that orienting electrodes such that the electrolyzing current passes substantially perpendicular to the flow of the grains minimizes changes in anode-cathode distances since in this orientation the grains present less reactive sites to the electrolyzing current. That is, if the electrolyzing current is passed parallel to grain orientation, it encounters more edges which are believed to be more reactive.

Carbonaceous material used for the production of electrodes in accordance with the present invention can be derived from petroleum coke or coke derived from coal. When petroleum coke is used, typically it is calcined initially at a temperature in the range of 800° to 1600° C. and thereafter pitch is added to provide a mix having a pitch content of about 10 to 30 wt.%. The mix is typically extruded to provide carbonaceous members which may then be cut or machined into electrodes. Thus, it will be noted that prior to cutting or machining, the orientation of the grains or crystals must be determined in order that the electrodes can be arranged in the cell in accordance with the principles of the present invention. Further, typically the extruded member is quenched, then baked at a temperature in the range of 800° to 1600° C. and treated with pitch to increase its density. Normally, it is then subjected to a final graphitizing temperature in the range of 2000° to 3100° C.

Carbonaceous material highly suitable for use as electrodes in the process of the subject invention may be obtained from Airco Speer Carbon-Graphite, Electrode Department, 800 Theresia Street, St. Marys, Pennsylvania 15857. Carbonaceous material referred to as graphite grade As-12 has been found to be the most suitable although grades referred to as AS-13, As-6 and AS-11 may also be used.

As well as arranging the electrode in the cell in accordance with the present invention, it is important that the electrode have controlled properties in order to minimize changes in anode-cathode distance. Thus, for purposes of the present invention, the electrode can have a density in the range of 1400 to 2000 kg/m$^3$ with a preferred density in the range of 1550 to 1900. Typically, the density of the material is in the range of 1700 to 1800 kg/m$^3$. In addition, the electrode should have a controlled grain size. That is, for purposes of the present invention, the grain size of the carbonaceous material should be in the range of $1.0 \times 10^{-6}$m to $1.0 \times 10^{-2}$m with a preferred range being $2.0 \times 10^{-6}$ m to $6.6 \times 10^{-3}$m. Also, it is important that the coefficient of thermal expansion in the grain flow direction be controlled so as to be in the range of $1.0 \times 10^{-6}$ to $7.0 \times 10^{-6}$ in/in/° C., with a preferred range being $1.5 \times 10^{-6}$ to $6.0 \times 10^{-6}$ in/in/° C. The carbon structure should also be controlled to provide a crystallite size in C-direction in the range of 60 to 500 angstroms, with a preferred range being 100 to 450 angstroms. Also, the ash content of carbonaceous material constituting the electrode should be controlled so as to be in the range of 0.0001 to 5.0 wt.% with a highly preferred range being 0.02 to 3.0. The electrical resistivity in the grain flow direction should also be controlled in the range of 1.0 to 50.0 $\mu\Omega$m with the preferred range being 5.0 to 30.0 $\mu\Omega$m. It should be understood that it is important to have the properties of the carbonaceous material constituting the electrode controlled in this way in order to ensure maximum life.

The electrolyte employed for producing light metal in accordance with the subject invention normally will comprise a molten bath composed essentially of aluminum or magnesium chloride, for example, dissolved in one or more halides of higher decomposition potential than aluminum chloride. By electrolysis of such a bath, chlorine is produced on the anode surfaces and light metal on the cathode surfaces of the cell electrodes. The metal is conveniently separated by setting from the lighter bath, and the chlorine rises to be vented from the cell. In such practice of the subject invention, the molten bath may be positively circulated through the cell by the buoyant gas lift effect of the internally produced chlorine gas, and light metal chloride is periodically or continuously introduced into the bath to maintain the desired concentration thereof.

The bath composition, in addition to the dissolved aluminum or magnesium chloride, for example, will usually be made up of alkali metal chloride although other alkali metal halide and alkaline earth halide may also be employed. A presently preferred aluminum chloride containing composition comprises an alkali metal chloride base composition made up of about 50 to 75 wt.% sodium chloride and 25 to 50 wt.% lithium chloride. Aluminum chloride is dissolved in such halide composition to provide a bath from which aluminum may be produced by electrolysis, and an aluminum chloride content of about 1½ to 10 wt.% of the bath will generally be desirable. As an example, a bath analysis as follows is satisfactory: 53 wt.% NaCl, 40 wt.% LiCl, 0.5 wt.% $MgCl_2$, 0.5 wt.% KCl, 1 wt.% $CaCl_2$ and 5 wt.% $AlCl_3$. In such bath, the chlorides other than NaCl, LiCl and $AlCl_3$ may be regarded as incidental components or impurities. The bath is employed in molten condition, usually at a temperature above that of molten aluminum and in the range between 660° and 730° C., typically at about 700° C.

It will be appreciated that while the electrodes have been shown stacked in a substantially horizontal arrangement, the invention will have application to electrodes provided in a vertical arrangement as shown in British Pat. No. 687,758, incorporated herein by reference.

It will be understood that the electrodes of the present invention may be used as anodes, cathodes or bipolar electrodes. Also, it should be noted that it is normally only necessary to use the electrodes as cathodes and bipolar electrodes in order to realize the benefit of the present invention.

The following example is further descriptive of the invention:

EXAMPLE 1

Carbon cathodes formulated from graphite grade AS-6 (available from Airco Speer) were tested in an electrolytic cell used for the production of aluminum from aluminum chloride. In one test, electrolyzing current was passed through the cell such that its flow direction was substantially perpendicular to grain flow direction. In another test, the electrolyzing current was passed through the cell so as to flow substantially parallel to the grain direction. The tests were conducted using an electrolyte comprising 65 wt.% NaCl, 28 wt.% LiCl and 7 wt.% $AlCl_3$. The electrolyte was maintained at a temperature of 710° C. The density of the electric current being passed through the cell during the test was 8 amps/in$^2$. After operating the cell for a certain time period, the cathodes were cleaned of electrolyte and aluminum and its dimensions measured as tabulated below to determine the effect of the grain orientation:

| Direction of Current Flow | Duration of Test (hrs) | Dimensional Loss (thickness) of Cathode Face (mm) | Starting Thickness (mm) | Starting Weight (gms) | Wt. Loss of Sample (gms) |
|---|---|---|---|---|---|
| Perpendicular to grain direction | 65 | 0.033 | 16.00 | 18.6 | 0.43 |
| " | 175 | 0.033 | 16.00 | 18.4 | 0.47 |
| Parallel to grain direction | 65 | 0.076 | 16.00 | 18.2 | 0.54 |
| " | 175 | 0.160 16.00 | 18.2 | 0.96 | |

It can be seen from the data that the cathode is much more subject to wear when the electrolyzing current is passed parallel to the grain direction. That is, when the electrolyzing current is passed substantially perpendicular to the grain direction the wear on the cathode is minimized.

While the invention has been described in terms of preferred embodiments, the claims appended hereto are intended to encompass other embodiments which fall within the spirit of the invention.

What is claimed is:

1. A process for producing metal in an electrolytic cell containing metal halide dissolved in a molten solvent of higher decomposition potential, the cell having a terminal anode, a terminal cathode and at least one bipolar electrode arranged to operate with the anode and the cathode providing inter-electrode spaces therebetween, the process which comprises the steps of:

(a) providing at least one electrode comprised of carbonaceous material;

(b) determining the direction of grain flow in the carbonaceous material constituting the electrode;

(c) arranging said electrode in said cell such that the direction of electrolyzing current flow through the cell is in a direction substantially perpendicular to the direction of grain flow in the electrode; and (d) electrolyzing the cell, thereby producing halogen gas on each anode surface thereof and metal on each cathode surface.

2. The process according to claim 1 wherein the electrode in step (a) is a bipolar electrode.

3. The process according to claim 1 wherein the electrode in step (a) has a density in the range of 1400 to 2000 kg/m$^3$.

4. The process according to claim 1 wherein the electrode in step (a) has a density in the range of 1700 to 1880 kg/m$^3$.

5. The process according to claim 1 wherein the carbonaceous material in the electrode in step (a) has a grain size in the range of $1.0 \times 10^{-6}$ to $1.0 \times 10^{-2}$ m.

6. The process according to claim 1 wherein the carbonaceous material in the electrode in step (a) has a coefficient of thermal expansion in the range of $1.0 \times 10^{-6}$ to $7.0 \times 10^{-6}$ in/in/°C.

7. The method according to claim 1 wherein the carbonaceous material in step (a) has an ash content in the range of 0.02 to 3.0 wt.%.

8. The method according to claim 1 wherein the carbonaceous material in step (a) has an electrical resistivity in the direction of grain flow in the range of 5.0 to 30 $\mu\Omega$m.

9. A process for producing aluminum in an electrolytic cell containing aluminum chloride dissolved in a molten solvent of higher decomposition potential, the cell having a terminal anode, a terminal cathode and at least one bipolar electrode arranged to operate with the anode and the cathode providing inter-electrode spaces therebetween, the process which comprises the steps of:

(a) providing at least one electrode comprised of carbonaceous material having a density in the range of 1400 to 2000 kg/m$^3$, a grain size in the range of $2.0 \times 10^{-6}$ to 6.6 to $10^{-3}$ m, a coefficient of thermal expansion of $1.0 \times 10^{-6}$ to $7.0 \times 10^{-6}$ in/in/°C., an ash content of 0.02 to 3.0 wt.% and an electrical resistance in the range of 5.0 to 30 $\mu\Omega$m;

(b) determining the direction of grain flow in the carbonaceous material constituting the electrode;

(c) arranging said electrode in said cell such that the direction of electrolyzing current flow through the cell is in a direction substantially perpendicular to the direction of grain flow in the electrode; and (d) electrolyzing the cell, thereby producing chlorine on each anode surface thereof and aluminum on each cathode surface, the aluminum being swept from the cathode surface by bath material.

10. In a process for producing aluminum in an electrolytic cell containing aluminum chloride dissolved in a molten solvent of higher decomposition potential, the cell having a terminal anode, a terminal cathode and a bipolar electrode arranged to operate with the anode and the cathode providing inter-electrode spaces therebetween, wherein chlorine is produced on each anode surface thereof and aluminum on each cathode surface by electrolyzing the cell, the aluminum being swept from the cathode surface by bath material, the process wherein the improvement comprises utilizing an electrode comprised by carbonaceous material wherein the direction of grain flow constituting the carbonaceous material has been determined and the electrode is arranged in the cell such that the direction of current flow through the cell is in a direction substantially perpendicular to the flow of the grains in the electrode.

11. In a process for producing aluminum in an electrolytic cell containing aluminum chloride dissolved in a molten solvent of higher decomposition potential, the cell having a terminal anode, a terminal cathode and a bipolar electrode arranged to operate with the anode and the cathode providing inter-electrode spaces therebetween, wherein chlorine is produced on each anode surface thereof and aluminum on each cathode surface by electrolyzing the cell, the aluminum being swept from the cathode surface by bath material, the process wherein the improvement comprises utilizing an electrode comprised of carbonaceous material wherein the direction of grain flow constituting the carbonaceous material has been determined and the electrode is arranged in the cell such that the direction of current flow through the cell is in a direction substantially perpendicular to the flow of the grains in the electrode, the carbonaceous material characterized by having a density in the range of 1550 to 1900 kg/m$^3$, a grain size in the range of $2.0 \times 10^{-6}$ to $6.6 \times 10^{-3}$ m, a coefficient of thermal expansion of $1.5 \times 10^{-6}$ to $6.0 \times 10^{-6}$ in/in/°C. and an ash content in the range of 0.02 to 3.0 wt.%.

* * * * *

UNITED STATES PATENT AND TRADEMARK OFFICE

CERTIFICATE OF CORRECTION

PATENT NO. : 4,121,983

DATED : October 24, 1978

INVENTOR(S) : Donald L. Kinsoz et al

It is certified that error appears in the above-identified patent and that said Letters Patent are hereby corrected as shown below:

| | |
|---|---|
| Col. 1, line 16 | Change "822,195" to --3,822,195--. |
| Col. 1, line 36 | After "to" insert --the--. |
| Col. 2, line 42 | Change "chloride" to --chlorine--. |
| Col. 4, line 31 | Change "As-12" to --AS-12--. |
| Col. 4, line 32 | Change "As-6" to --AS-6--. |
| Col. 4, line 41 | Change "1800" to --1880--. |
| Col. 5, line 5 | Change "setting" to --settling--. |
| Col. 6 For entry entitled Parallel to grain direction (second occurrence indicated by ") | Change "0.160 16.00" to --0.160--; "18.2" to --16.00--; "0.96" to --18.2--; and under last heading enter --0.96--. |

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*